US005417593A

United States Patent [19]

Suzuki et al.

[11] Patent Number: 5,417,593

[45] Date of Patent: May 23, 1995

[54] BRANCH CONNECTOR FOR CONNECTIONS OF A CORD TO A MALE CONNECTOR AND A FEMALE CONNECTOR

[75] Inventors: Noriyasu Suzuki; Akihito Sukegawa, both of Mito, Japan

[73] Assignee: Mitsumi Electric Co., Ltd., Tokyo, Japan

[21] Appl. No.: 133,899

[22] Filed: Oct. 12, 1993

[30] Foreign Application Priority Data

Oct. 16, 1992 [JP] Japan ..... 4-078583 U

[51] Int. Cl.[6] ..... H01R 25/00

[52] U.S. Cl. ..... 439/651; 439/607; 439/638

[58] Field of Search ..... 439/607–610, 439/638–655

[56] References Cited

U.S. PATENT DOCUMENTS

| | | | |
|---|---|---|---|
| 2,554,554 | 5/1951 | Billeter | 439/652 |
| 3,159,443 | 12/1964 | Hart | 439/650 |
| 3,493,915 | 2/1970 | Cox | 439/651 |
| 3,745,515 | 7/1973 | Michaels | 439/651 |
| 4,236,779 | 12/1980 | Tang | 439/610 |
| 4,508,414 | 4/1985 | Kusui et al. | 439/610 |
| 5,192,226 | 3/1993 | Wang | 439/650 |

*Primary Examiner*—David L. Pirlot
*Attorney, Agent, or Firm*—Ladas & Parry

[57] ABSTRACT

A branch connector includes a socket mold in which a plurality of socket type contact parts are fitted, a plug mold in which a plurality of plug type contact parts are fitted, and a plurality of resiliently deformable conduction parts, formed as being integral with the plug type contact parts of the plug mold, for enabling electric connection between the plug type contact parts and the socket type contact parts of the socket mold. In this branch connector, the plurality of conduction parts longitudinally extend from internal ends of the plug type contact parts of the plug mold to intermediate portions of the socket type contact parts of the socket mold, and the conduction parts having edges which are brought into pressure contact with the intermediate portions of the socket type contact parts by using the resilient deformation of the conduction parts.

8 Claims, 5 Drawing Sheets

BRANCH CONNECTOR FOR CONNECTIONS OF A CORD TO A MALE CONNECTOR AND A FEMALE CONNECTOR

BACKGROUND OF THE INVENTION (1) Field of the Invention

The present invention relates to a branch connector, and more particularly to a branch connector for branch connections of a wire cord to a male connector and a female connector, the branch connector including socket type contact parts and plug type contact parts through which the male and female connectors are connected.

(2) Description of the Related Art

First, a description will be given of a conventional branch connector with reference to FIGS. 1 and 2. In FIGS. 1 and 2, a branch connector 50 generally has a socket mold 12, a plug mold 14, and a cover member 16. In the socket mold 12 a plurality of socket type contact parts 20 are fitted, and these parts 20 are to be connected to or disconnected from a plurality of plug type contact parts of a male connector which is one mating connector for the branch connector 50. In the plug mold 14 a plurality of plug type contact parts 30 are fitted, and these parts 30 are to be connected to or disconnected from a plurality of socket type contact parts of a female connector which is the other mating connector for the branch connector 50. The cover member 16 is arranged so as to enclose the socket mold 12 and the plug mold 14, and the contact parts 20 in the socket mold 12 and the contact parts 30 in the plug mold 14 are separated from each other by a given distance along a longitudinal axis of the branch connector 50.

The cover member 16 is made up of a front upper portion, a front lower portion, a rear upper portion and a rear lower portion, and the cover member 16 can be divided into there four portions. A sidewise projecting portion 22 is formed on a side surface of the cover member 16, and a cord 19 including several bundled wires (not shown) is inserted into the projecting portion 22. Within the branch connector 50, the wires of the cord 19 are connected to a plurality of crimped portions of the contact parts 20 in the socket mold 12.

As shown in FIG. 2, in the branch connector 50, the socket type contact parts 20 and the plug type contact parts 30 are electrically connected to each other by soldering. Lines extended from the terminals of the contact parts 20 and lines extended from the terminals of the contact parts 30 are joined by soldering, which enables the electric connection between the contact parts 20 and 30.

FIG. 3 shows a conventional branch connector including another means for enabling the electric connection between the contact parts described above, which is different from the branch connector shown in FIGS. 1 and 2. In FIG. 3, the parts which are the same as corresponding parts in FIGS. 1 and 2 are designated by the same reference numerals, and a description thereof will be omitted. In a branch connector 60 in FIG. 3, a printed circuit board 65 is arranged within the connector 60, and the terminals of the contact parts 20 and the terminals of the contact parts 30 are separately joined to the printed circuit board 65 by soldering, thereby enabling the electric connection between the contact parts 20 and the contact parts 30.

Therefore, in order to produce the branch connector described above in the assembly line, it is necessary to perform the soldering to join the terminals of the contact parts 20 and the terminals of the contact parts 30 (or to join the terminals of the contact parts 20 and 30 and the printed circuit board 65). The assembling operation for the above branch connector becomes somewhat complicated and time-consuming due to the soldering step. Thus, the manufacturing cost relating to the above branch connector becomes unnecessarily high, and the quality level of the products becomes unstable.

SUMMARY OF THE INVENTION

Accordingly, it is a general object of the present invention to provide an improved branch connector in which the above described problems are eliminated.

Another, more specific object of the present invention is to provide a branch connector which can easily and simply achieve the branch connections of a cord to a male connector and a female connector by uniquely realizing the electric connection between the socket type contact parts and the plug type contact parts.

Still another object of the present invention is to provide a branch connector which will make the manufacturing cost to become lower than that of the conventional branch connector and will allow the quality level of the products to be stabilized.

The above mentioned objects of the present invention are achieved by a branch connector which includes a socket mold in which a plurality of socket type contact parts are fitted to enable a plurality of plug contact parts of a male connector to be connected to the socket type contact parts, a plug mold in which a plurality of plug type contact parts are fitted to enable a plurality of socket contact parts of a female connector to be connected to the plug plug type contact parts, and a plurality of resiliently deformable conduction parts, respectively formed as being integral with the plug type contact parts of the plug mold, for enabling electric connection between the plug type contact parts and the socket type contact parts of the socket mold. In the above mentioned branch connector, the plurality of conduction parts longitudinally extend from internal ends of the plug type contact parts of the plug mold to intermediate portions of the socket type contact parts of the socket mold, and the conduction parts having edges which are brought into pressure contact with the intermediate portions of the socket type contact parts by using the resilient deformation of the conduction parts.

According to the present invention, it is possible to electrically connect the socket type contact parts and the plug type contact parts with no needs of the soldering and the printed circuit board. Therefore, the electric connection between the contact parts can be easily and simply realized by providing the branch connector of the present invention with the edges of the conduction parts. The manufacturing cost relating to the branch connector of the present invention can be reduced when compared with the manufacturing cost relating to the conventional branch connector, and the quality level of the branch connector of the invention can be stabilized.

BRIEF DESCRIPTION OF THE DRAWINGS

The above and other objects, features and advantages of the present invention will become apparent from the following detailed description when read in conjunction with the accompanying drawings in which.

DESCRIPTION OF THE PREFERRED EMBODIMENT

Figure 1:
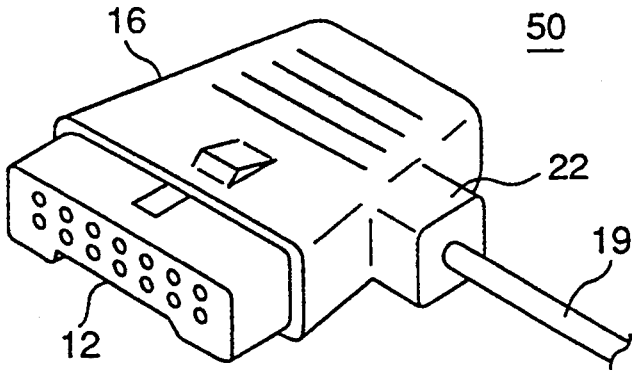
FIG.1 PRIOR ART
FIG. 1 is a perspective view showing an example of a conventional branch connector.

A description will now be given of a preferred embodiment of the present invention with reference to FIGS. 4 through 13.

FIGS. 4 through 13 illustrate the preferred embodiment of the branch connector according to the present invention. In FIGS. 4 through 13, the parts which are the same as corresponding parts shown in FIGS. 1 through 3 are designated by the same reference numerals, and a description thereof will be omitted.

Figure 2:
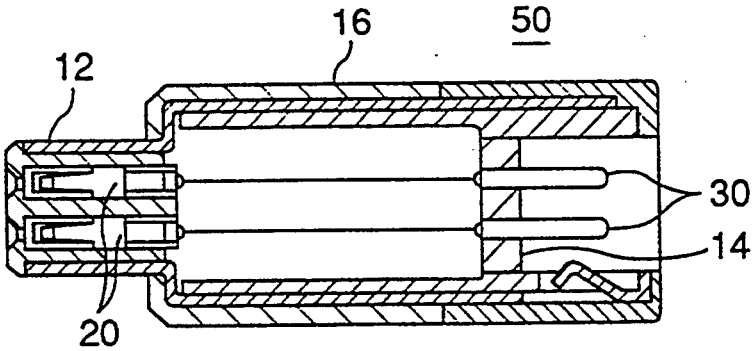
FIG.2 PRIOR ART
FIG. 2 is a sectional view showing the conventional branch connector in FIG. 1.
Figure 3:
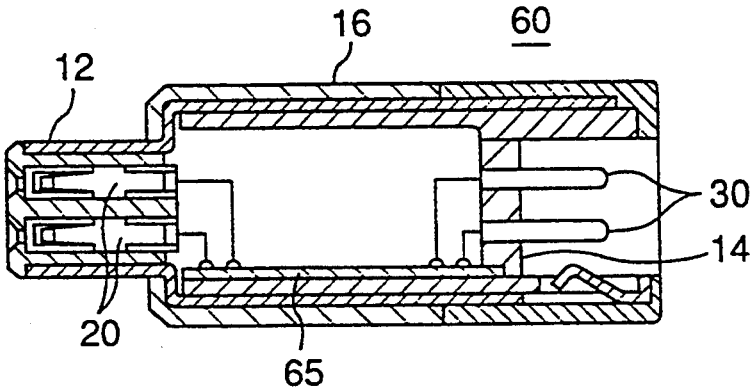
FIG.3 PRIOR ART
FIG. 3 is a sectional view showing a different example of the conventional branch connector.
Figure 4:
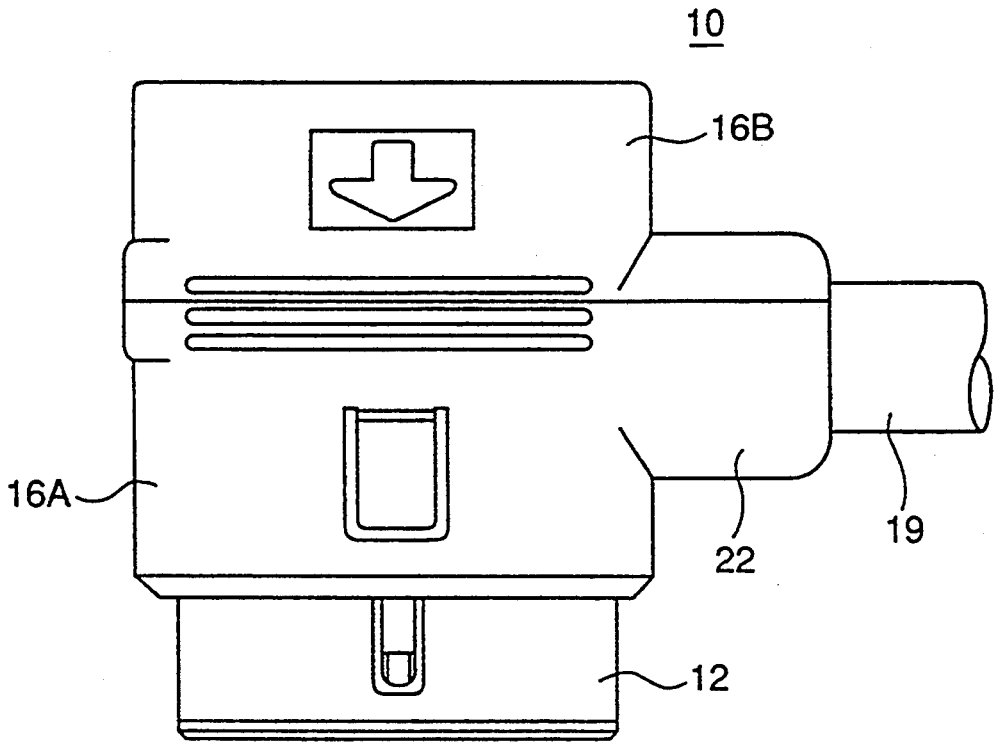
FIG. 4 is a plan view showing a preferred embodiment of the branch connector according to the present invention.

Similarly to the conventional branch connectors 50 and 60 in FIGS. 1 through 3, a branch connector 10 shown in FIGS. 4–7 comprises the socket mold 12 in which the plurality of socket type contact parts 20 are fitted, and the plug mold 14 in which the plurality of plug type contact parts 30 are fitted. The socket type contact parts 20 are to be connected to or disconnected from a plurality of plug type contact parts of a male connector which is one mating connector for the branch connector 10. The plug type contact parts 30 are to be connected to or disconnected from a plurality of socket type contact parts of a female connector which is the other mating connector for the branch connector 10.

Figure 8:
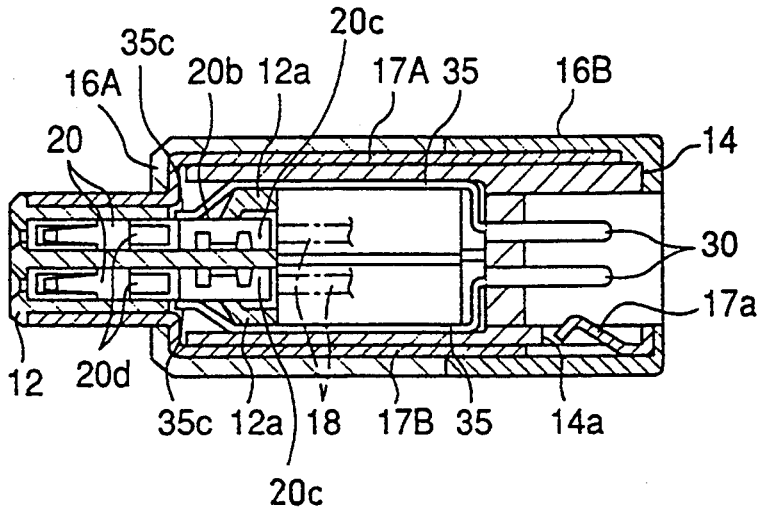
FIG. 8 is a sectional view showing the branch connector taken along a line X—X indicated in FIG. 5.
Figure 9:
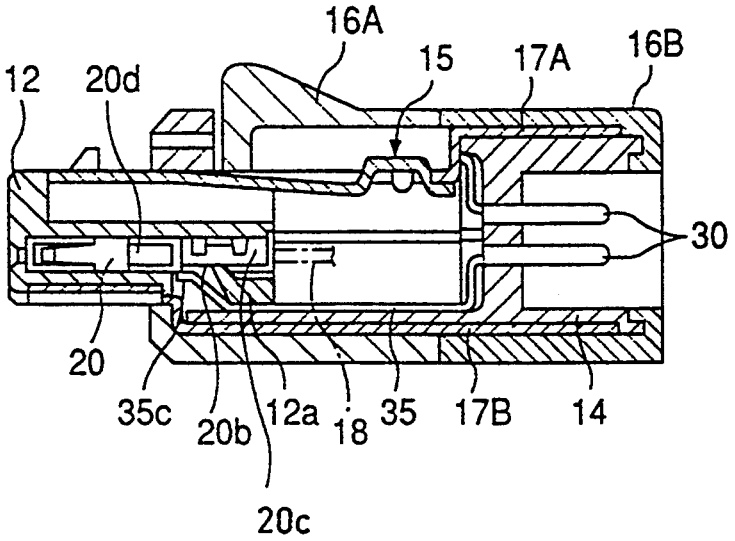
FIG. 9 is a sectional view showing the branch connector taken along a line Y—Y indicated in FIG. 5.

The branch connector 10 in FIGS. 4–7 further comprises a cover unit including a lock piece 15, an external front cover member 16A, an external rear cover member 16B, an internal upper shield case 17A, and an internal lower shield case 17B as shown in FIGS. 8 and 9. The upper and lower shield cases 17A and 17B are arranged on the top surfaces of the socket mold 12 and the plug mold 14 and on the bottom surfaces thereof respectively, so as to shield the internal parts of the branch connector 10. The front and rear cover members 16A and 16B are arranged on some exposed surfaces of the lock piece 15, the shield cases 17A, 17B, the socket mold 12 and the plug mold 14 to enclose these parts of the branch connector 10 therein. The above described cover unit is such designed that the contact parts 20 of the socket mold 12 and the contact parts 30 of the plug mold 14 are separated from each other by a given distance along the longitudinal axis (the front-to-rear direction) of the branch connector 10 as shown in FIGS. 8 and 9.

As shown in FIGS. 4–7, the projecting portion 22 extends from side portions of the front cover 16A and the rear cover 16B at one side surface of the branch connector 10. The projecting portion 22 has a generally square cross section and serves as a connection port for the cord 19 containing a plurality of bundled wires 18. The cord 19 is to be inserted into the projecting portion 22 of the branch connector 10 for the purpose of the branch connections of the cord 19 to the male and female connectors. Within the branch connector 10, the wires 18 of the cord 19 are respectively connected to a plurality of crimped portions 20*c* of the contact parts 20 in the socket mold 12 as shown in FIG. 8.

Figure 10:
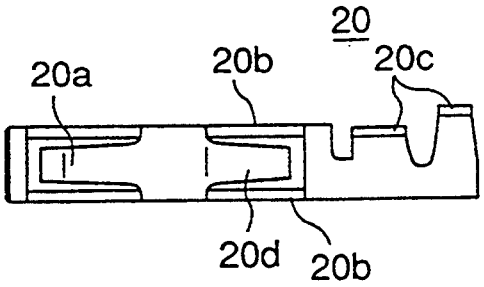
FIG. 10 is a side view showing one of a plurality of socket type contact parts of the branch connector of the present invention.
Figure 11:
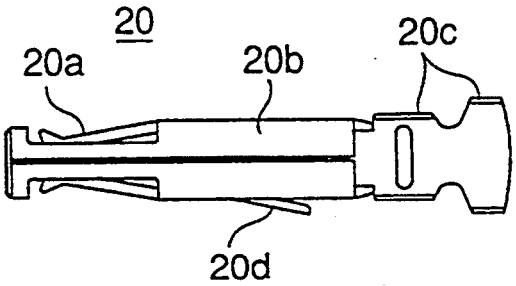
FIG. 11 is a plan view showing the socket type contact part of the branch connector shown in FIG. 10.

FIGS. 10 and 11 show one of the plurality of the socket type contact parts 20 in the socket mold 12. This contact part 20 is produced from a thin metal sheet by bending. The socket type contact part 20 is a hollow, generally cylindrical part having a generally square cross section at the intermediate portion of the part. Two inwardly deflected contact portions 20*a* are formed on two mutually opposed front side surfaces of the contact part 20 so as to forwardly extend from intermediate side portions of the contact part 20. A crimped portion 20*c* is formed at the rear of the contact part 20, and one of the bundled wires 18 of the cord 19 is connected to this crimped portion 20*c* by crimping. An outwardly deflected lance portion 20*d* is formed on one side surface of the contact part 20 so as to rearward extend from the intermediate side portion of the contact part 20. This lance portion 20*d* serves to prevent the contact part 20 from being detached from the branch connector 10. A contact portion 20*b* is formed on the other side surface of the contact part 20 (which surface is opposite to the side surface where the lance portion 20*d* is formed) so as to allow an edge portion (which will be described below) of the plug type contact part 30 to be connected to this contact portion 20*b* of the socket type contact part 20 by using the resilient deformation of the contact part 30.

Figure 12:
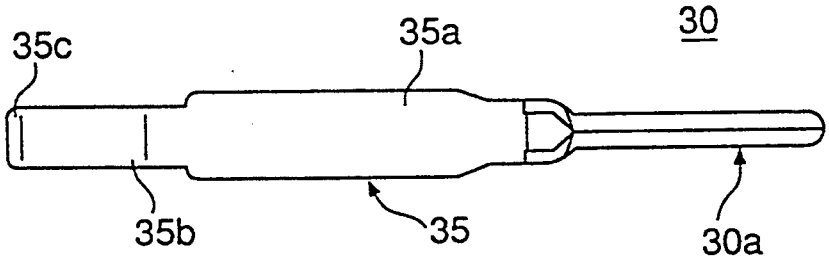
FIG. 12 is a side view showing one of a plurality of plug type contact parts of the branch connector of the present invention.
Figure 13:
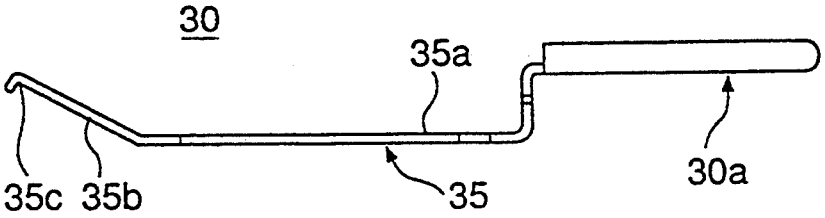
FIG. 13 is a plan view showing the plug type contact part of the branch connector shown in FIG. 12.

FIGS. 12 and 13 show one of the plurality of the plug type contact parts 30 in the plug mold 14. This contact part 30 is produced from a thin metal sheet by bending. The plug type contact part 30 is an elongated composite part which has a rearward extending, cylindrical contact portion 30*a* and a thin, rectangular conduction portion 35 formed integrally with the contact portion 30*a*. The contact portion 30*a* has a rounded rear edge accommodated in the plug mold 14, and this portion 30*a* is connected to or disconnected from one of the plurality of the socket type contact parts of the mating female connector for the branch connector 10.

The conduction portion 35 in FIGS. 12 and 13 has a horizontally extending bridge area 35*a* (with an L-shaped connecting step connected to the front end of the contact portion 30*a*), an inwardly deflected slanting area 35*b* (forwardly extending from the front end of the bridge area 35*a*), and a curved edge 35*c* at the front end of the slanting area 35*b*. The bridge area 35*a* extends along the longitudinal axis of the contact part 30 for allowing the contact part 30 in the plug mold 14 and the contact part 20 in the socket mold 12 to be interconnected. The slanting area 35*b* is resiliently deformable at the front end of the bridge area 35*a*, so that the curved edge 35c is connected to the socket type contact part 20 by using the resilient deformation of the slanting area 35b to the bridge area 35a.

As shown in FIGS. 8 and 9, the slanting areas 35b of the contact parts 30 are placed into recessed portions 12a of the socket mold 12 such that the curved edges 35c at the front ends of the slanting areas 35b are connected to the intermediate side portions 20b of the socket type contact parts 20 by using the resilient deformation of the slanting areas 35b mentioned above. On the other hand, the contact portions 30a of the contact parts 30 are fitted in the plug mold 14, and the contact portions 30a rearward project inside the plug mold 14.

Figure 5:
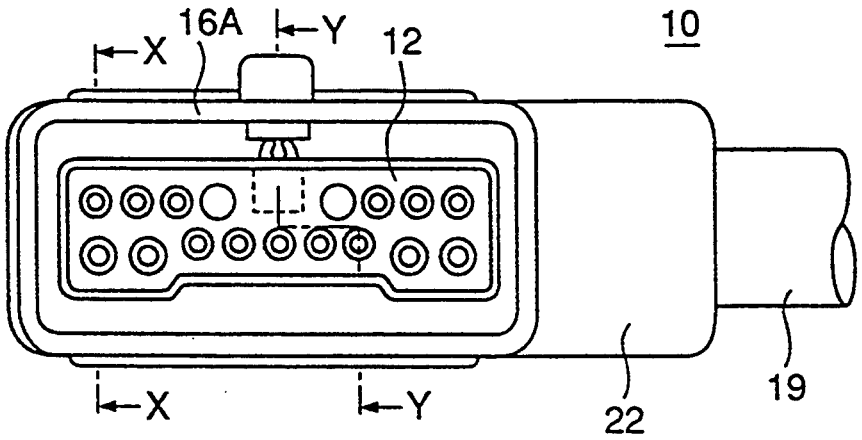
FIG. 5 is a front view showing a socket mold portion of the branch connector shown in FIG. 4.
Figure 6:
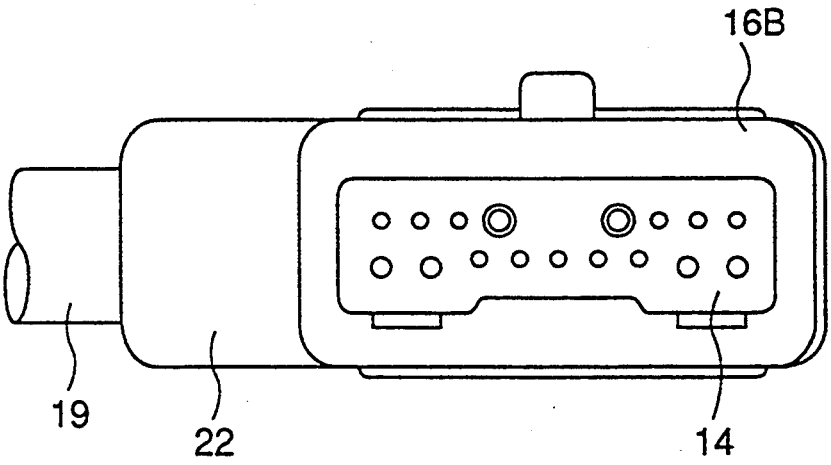
FIG. 6 is a rear view showing a plug mold portion of the branch connector shown in FIG. 4.
Figure 7:
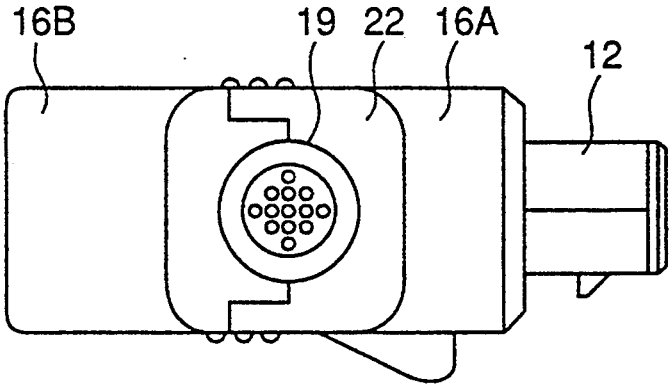
FIG. 7 is a side view showing a connection cord of the branch connector shown in FIG. 4.

As shown in FIG. 5, the plurality of the socket type contact parts 20 described above are fitted in the socket mold 12 in two upper and lower rows. In the example shown in FIG. 5, six contact parts 20 are aligned in the upper row of the socket mold 12 (three contact parts on the right and left sides arranged respectively), and five contact parts 20 are aligned in the lower row (arranged in the middle thereof). The lances 20d of these contact parts 20 are arranged to place all the lances 20d of the contact parts 20 on the same side. The contact portions 20b of the contact parts 20 in the upper row of the socket mold 12 are arranged to place the edges 35c of the conduction portions 35 on the top of the contact parts 20. The contact portions 20b of the contact parts 20 in the lower row are arranged to place the edges 35c of the conduction portions 35 on the bottom of the contact parts 20.

On the other hand, the plurality of the plug type contact parts 30 described above are fitted in the plug mold 14 in a manner corresponding to the socket type contact parts 20 mentioned above, such that the curved edges 35c of the conduction portions 35 thereof are connected to all the contact portions 20b of the contact parts 20. The slanting areas 35b of the contact parts 30 arranged in the upper row of the plug mold 14 face to the bottom, and the slanting areas 35b of the contact parts 30 arranged in the lower row of the plug mold 14 face to the top, as shown in FIGS. 8 and 9.

As shown in FIG. 8, the lower shield case 17B of the cover member is formed with a grounding contact portion 17a, and this portion 17a is connected to the mating female connector for the purpose of grounding. The plug mold 14 of the branch connector 10 is formed with an opening 14a, and the grounding contact portion 17a inwardly projects from the opening 14a within the plug mold 14.

As shown in FIGS. 8 and 9, the plug mold 14 is formed with an internal surface on which the plurality of bridge areas 35a of the conduction portions 35 are supported. The internal surface of the plug mold 14 longitudinally extends from the internal ends of the plug type contact parts 30 to the intermediate portions of the socket type contact parts 20 of the socket mold 12. The socket mold 12 is formed with internal surface portions at rear end portions of the socket mold 12. The internal surface portions of the socket mold 12 press the plurality of bridge areas 35a of the conduction portions 35 on the internal surface of the plug mold 14. Thus, the curved edges 35c of the conduction portions 35 are brought into pressure contact with the intermediate portions 20b of the socket type contact parts 20 by using the resilient deformation of the slanting areas 35b of the conduction portions 35.

Next, the assembling process for assembling the branch connector 10 described above in the assembly line will be described. The branch connector 10 according to the present invention is assembled in the following sequence:

(1) The socket type contact parts 20 are fitted in the socket mold 12. Prior to this fitting, the wires 18 of the cord 19 are respectively connected to the crimped portions 20c of the contact parts 20 by crimping.

(2) The plug type contact parts 30 including the respective conduction portions 35 are fitted in the socket mold 14.

(3) The socket mold 12 and the plug mold 14 are coupled to each other. At this time, the curved edges 35c of the conduction portions 35 formed integrally with the plug type contact parts 30 in the plug mold 14 are respectively connected to the contact portions 20b of the socket type contact parts 20 in the socket mold 12 by using the resilient deformation of the slanting areas 35b.

(4) The socket mold 12 and the plug mold 14 thus assembled are covered with the upper and lower shield cases 17A and 17B.

(5) The front and rear covers 16A and 16B are mounted on the socket mold 12 and the plug mold 14 so as to protect the shield cases 17A and 17B.

In the above described embodiment of the branch connector 10, the curved edges 35c of the conduction portions 35 formed integrally with the plug type contact parts 30 are connected to the contact portions 20b of the socket type contact parts 20 by using the resilient deformation of the slanting areas 35b (the step 3 above), thus allowing the electric connection between the socket type contact parts and the plug type contact parts 30 with no needs of the soldering and the printed circuit board. Accordingly, the electric connection between the socket type contact parts and the plug type contact parts can be easily and simply realized by the edges of the conduction parts of the branch connector according to the present invention. The manufacturing cost relating to the branch connector of the present invention can be reduced when compared with the manufacturing cost relating to the conventional branch connector, and the quality level of the branch connector thus assembled can be stabilized.

Further, the present invention is not limited to the above described embodiment, and variations and modifications may be made without departing from the scope of the present invention.

What is claimed is:

1. A branch connector for branch connections of a cord to a male connector and a female connector, said branch connector comprising:

a socket mold which includes a plurality of socket type contact parts fitted therein to allow a plurality of plug contact parts of a male connector to be connected to said socket type contact parts;

a plug mold which includes a plurality of plug type contact parts fitted therein to enable a plurality of socket contact parts of a female connector to be connected to said plug type contact parts; and a plurality of resiliently deformable conduction means, each of which has a first edge integrally formed with a distal end of said respective plug type contact parts of said plug mold, and a second edge brought into contact with an intermediate portion of said respective socket type contact parts of said socket mold, such that said plurality of conduction means enable respectively electric connections between said plug type contact parts and said socket type contact parts, wherein said plurality of conduction means longitudinally extend from said distal ends of said plug type contact parts of said plug mold to said intermediate portions of said socket type contact parts of said socket mold, said second edges of said conduction means being brought into pressure contact with the intermediate portions of the socket type contact parts by means of the resilient deformation of said conduction means.

2. A branch connector according to claim 1, further comprising cover means for enclosing said socket mold and said plug mold within said branch connector, said cover means comprising two upper and lower shield cases and two front and rear cover members, and said cover members being formed with a projecting portion, said projecting portion serving as a connection port into which a cord including a plurality of bundled wires is inserted.

3. A branch connector according to claim 1, wherein said socket type contact parts of said socket mold have crimped portions at the respective rear end portions of the socket type contact parts so that a plurality of bundled wires of a cord inserted into said branch connector are connected to said crimped portions by crimping.

4. A branch connector according to claim 1, wherein each of said socket type contact parts of said socket mold is produced from a thin metal sheet by bending, and each of said plug type contact parts of said plug mold with which said conduction means are formed as being integral is produced from a thin metal sheet by bending.

5. A branch connector according to claim 1, wherein each of said plurality of conduction means comprises a slanting portion which extends in a slanting direction relative to a longitudinal axis of the plug type contact part with which the conduction means is formed as being integral, and each of said second edges of said plurality of conduction means being located at a front end of the slanting portion.

6. A branch connector according to claim 1, wherein said socket mold comprises a plurality of recessed portions which are formed at the respective intermediate portions of the sockets type contact parts, the second edges of the conduction means being reespectively passed through the recessed portions so as to allow the second edges of the conduction means to be connected to the intermediate portions of the socket type contact parts of the socket mold.

7. A branch connector according to claim 1, wherein said plug mold comprises an internal surface on which said plurality of conduction means are supported, and said internal surface of said plug mold longitudinally extending from the distal ends of said plug type contact parts to the intermediate portions of said socket type contact parts of said socket mold.

8. A branch connector according to claim 7, wherein said socket mold comprises internal surface portions for pressing said plurality of conduction means on said internal surface of said plug mold at rear end portions of the socket mold, so that the edges of the conduction means are brought into pressure contact with the intermediate portions of the socket type contact parts due to the resilient deformation of the conduction means.

* * * * *